US012649099B2

(12) United States Patent
Buck

(10) Patent No.: US 12,649,099 B2
(45) Date of Patent: Jun. 9, 2026

(54) PROTECTION DEVICES FOR USE WITH SPORTS SKATES

(71) Applicant: John T. Buck, Wantagh, NY (US)

(72) Inventor: John T. Buck, Wantagh, NY (US)

( * ) Notice: Subject to any disclaimer, the term of this patent is extended or adjusted under 35 U.S.C. 154(b) by 0 days.

(21) Appl. No.: 18/787,171

(22) Filed: Jul. 29, 2024

(65) Prior Publication Data

US 2025/0032889 A1 Jan. 30, 2025

Related U.S. Application Data

(60) Provisional application No. 63/529,695, filed on Jul. 29, 2023.

(51) Int. Cl.
*A63B 71/12* (2006.01)
*A63B 102/24* (2015.01)

(52) U.S. Cl.
CPC .. *A63B 71/1225* (2013.01); *A63B 2071/1258* (2013.01); *A63B 2071/1275* (2013.01); *A63B 2102/24* (2015.10); *A63B 2209/10* (2013.01)

(58) Field of Classification Search
CPC ..... A43B 5/1691; A43B 5/16; A43B 7/18
USPC ..... 2/22
See application file for complete search history.

(56) References Cited

U.S. PATENT DOCUMENTS 2,617,207 A * 11/1952 Jennett ..... A63B 71/1225 36/89
2,789,374 A * 4/1957 Planert ..... A63B 71/1225 36/89
4,964,402 A * 10/1990 Grim ..... F28D 20/023 602/2
4,966,134 A * 10/1990 Brewer ..... A61F 5/0111 128/882
5,092,319 A * 3/1992 Grim ..... A61F 5/0111 128/882
5,507,720 A * 4/1996 Lampropoulos ... A63B 71/1225 602/65
2005/0116379 A1* 6/2005 Goldsmith ..... B29C 70/345 264/222
2006/0145434 A1* 7/2006 Crowder ..... A63C 1/20 280/11.12
2007/0056189 A1* 3/2007 Schafer Mathison ... A43B 7/20 36/89
2017/0280819 A1* 10/2017 Corbeil ..... A43B 5/1608
2021/0337918 A1* 11/2021 Champagne ..... A43B 5/1691
2023/0079906 A1* 3/2023 Beland ..... A63B 71/1225 2/22

* cited by examiner

*Primary Examiner* — Matthew R Marchewka

(57) ABSTRACT

A protection device includes a first protective plate having a first through hole, a second protective plate having a second through hole, and a flexible strap. The flexible strap couples the first protective plate and the second protective plate. The protection device is configured for installation on a boot of a skate by threading a first end of a lace of the boot through the first through hole, and threading a second end of the lace through the second through hole, and tying the lace to secure the protection device in position above an upper rim of the boot. With the protection device installed, the first protective plate is disposed to cover a left ankle region and a first portion of an Achilles tendon of an individual, and the second protective plate is disposed to cover a right ankle region and a second portion of the Achilles tendon.

11 Claims, 8 Drawing Sheets

PROTECTION DEVICES FOR USE WITH SPORTS SKATES

CROSS-REFERENCE TO RELATED APPLICATION

This application claims the benefit of U.S. Provisional Application Ser. No. 63/529,695, filed on Jul. 29, 2023, the disclosure of which is fully incorporated herein by reference.

BACKGROUND

This disclosure relates generally to protection devices for use with sports skates, such as hockey skates. In the sport of hockey (e.g., ice hockey, street hockey, etc.), at any age or skill level, the skates that are used by hockey players (e.g., ice skates, or roller blade skates, etc.) are generally designed to provide some level of protection to the player from injury to the feet and ankles due to, e.g., impact from a hockey puck or hockey stick. On the other hand, hockey skates must be designed to allow sufficient ankle rotation and movement to enable proper maneuverability when skating. Consequently, such design constraints on hockey skates make players more vulnerable to potential injuries to, e.g., ankles and Archilles tendons.

SUMMARY

Exemplary embodiments of the disclosure include protection devices for use with sports skates such as hockey skates.

For example, an exemplary embodiment includes a protection device which comprises a first protective plate having a first through hole, a second protective plate having a second through hole, and a flexible strap. The flexible strap couples the first protective plate and the second protective plate. The protection device is configured for installation on a boot of a skate by threading a first end of a lace of the boot through the first through hole, and threading a second end of the lace through the second through hole, and tying the lace to secure the protection device in position above an upper rim of the boot.

With the protection device installed, the first protective plate is disposed to cover a left ankle region and a first portion of an Achilles tendon of an individual, and the second protective plate is disposed to cover a right ankle region and a second portion of the Achilles tendon.

In another exemplary embodiment, which may be combined with one or more of the embodiments of the preceding paragraphs, the first protective plate and the second protective plate each comprise a curved profile which is configured to wrap around upper ankle regions of an individual.

In another exemplary embodiment, which may be combined with one or more of the embodiments of the preceding paragraphs, the first protective plate and the second protective plate are formed of a rigid or semi-ridge plastic material.

In another exemplary embodiment, which may be combined with one or more of the embodiments of the preceding paragraphs, the first protective plate comprises a first pad element disposed on surface thereof, the second protective plate comprises a second pad element disposed on surface thereof.

In another exemplary embodiment, which may be combined with one or more of the embodiments of the preceding paragraphs, the first pad element and the second pad element each comprise a rubber pad or a gel pad.

In another exemplary embodiment, which may be combined with one or more of the embodiments of the preceding paragraphs, the first protective plate comprises a first tongue portion which comprises the first through hole, and the second protective plate comprises a second tongue portion which comprises the second through hole. The first tongue portion extends below a first bottom edge of the first protective plate, and the second tongue portion extends below a second bottom edge of the second protective plate.

In another exemplary embodiment, which may be combined with one or more of the embodiments of the preceding paragraphs, the first bottom edge and the second bottom edge each comprise a tapered edge which is configured to enable the first and second bottom edges of the respective first and second protective plates to slideably engage an inner surface of the upper rim of the boot.

In another exemplary embodiment, which may be combined with one or more of the embodiments of the preceding paragraphs, the first protective plate comprises a first extended portion which extends above a first upper edge of the first protective plate, and the second protective plate comprises a second extended portion which extends above a second upper edge of the second protective plate. The first extended portion and the second extended portion are configured and positioned to cover an Achilles tendon region of an individual, when the protection device is installed on the skate.

In another exemplary embodiment, which may be combined with one or more of the embodiments of the preceding paragraphs, the first upper edge and the second upper edge each comprise a tapered edge which is configured to enable the first and second upper edges of the respective first and second protective plates to slideably engage an inner surface of a shin guard.

In another exemplary embodiment, which may be combined with one or more of the embodiments of the preceding paragraphs, the first protective plate comprises a first slot, and the second protective plate comprises a second slot. The flexible strap comprises a first connecting portion and a second connecting portion, and is configured to be inserted through the first slot and the second slot and couple the first protective plate and the second protective plate by connecting the first connecting portion to the second connecting portion.

In another exemplary embodiment, which may be combined with one or more of the embodiments of the preceding paragraphs, the flexible strap further comprises a stretchable portion which is disposed between, and coupled to, the first and second connecting portions. The first and second connecting portions comprise hook and pile fasteners.

Other embodiments will be described in the following detailed description of exemplary embodiments, which is to be read in conjunction with the accompanying figures.

DETAILED DESCRIPTION OF EXEMPLARY EMBODIMENTS

Exemplary embodiments of the disclosure will now be described in further detail with regard to protection devices for use with sports skates such as hockey skates. The exemplary protection devices are configured for use with standard sport skates (e.g., hockey ice skates) to provide added protection to prevent or otherwise minimize the risk of injury to, e.g., ankles and Archilles tendons of skaters. The exemplary protection devices are configured for use with a wide variety of sports skates, such as hockey skates, wherein such sports skates can be readily retrofitted with a protection device to provide added protection from injuries to skaters due to e.g., high-speed impacts of hockey pucks to lower leg regions, or injuries and cuts to Archilles tendons as a result of being impacted or sliced from sharp skate blades of others during game play or practice sessions, etc. As explained in further detail below, an exemplary protection device can be installed on and utilized with a hockey skate to provide added protection from injury, while not providing any impediment to ankle rotation, flexion, and motion, in any manner, when skating, It is to be understood that various features shown in the accompanying drawings are schematic illustrations that are not drawn to scale. Moreover, the same or similar reference numbers are used throughout the drawings to denote the same or similar features, elements, or structures, and thus, a detailed explanation of the same or similar features, elements, or structures will not be repeated for each of the drawings. Further, the term "exemplary" as used herein means "serving as an example, instance, or illustration." Any embodiment or design described herein as "exemplary" is not to be construed as preferred or advantageous over other embodiments or designs.

Figure 1:
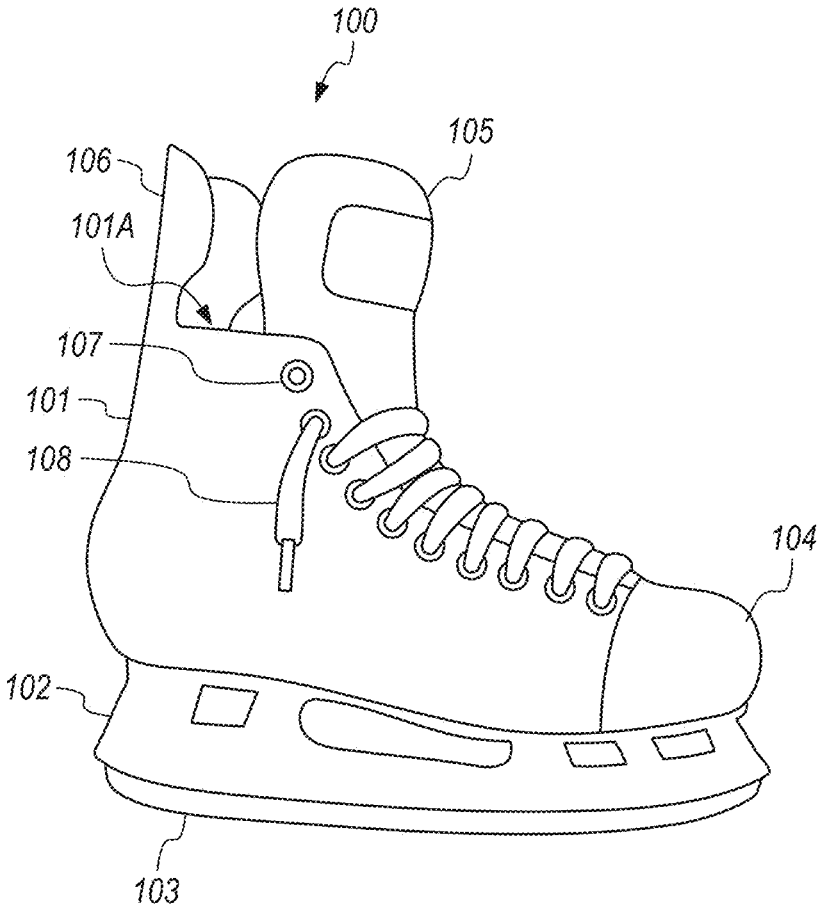
FIG. 1 (PRIOR ART)
FIG. 1 schematically illustrates a standard design of a hockey skate which can be retrofitted or otherwise utilized with a protection device according to an exemplary embodiment of the disclosure.

FIG. 1 schematically illustrates a standard design of a hockey skate which can be retrofitted or otherwise utilized with a protection device according to an exemplary embodiment of the disclosure. In particular, FIG. 1 schematically illustrates a hockey skate 100 (e.g., ice skate) which comprises a boot 101, a blade holder 102, and a metal blade 103. The boot 101 comprises a toe box 104, a padded tongue 105, an Achilles tendon guard 106 (or tendon guard), a plurality of eyelets 107, and a lace 108 which threads through the eyelets 107. The boot 101 is made of a rigid (yet flexible) material, such as high-grade polycarbonate material, and is configured to enclose and support the ankle and foot of a hockey player.

The hockey skate 100 is designed to provide some level of protection to the foot and ankle portions of a hockey player. For example, the boot 101 is capable of protecting the foot and portions of the ankle, which are covered by the boot 101, from high-speed impacts of hockey pucks against the boot 101 (e.g., high-speed impacts at speeds in excess of 80 mph), as well as guard against being sliced by another player's hockey skate blade. In addition, the padded tongue 105 and tendon guard 106 are designed to guard against high-speed impacts from hockey pucks, and from being sliced by another player's hockey skate blade. The tendon guard 106 is a safety feature that is typically implemented on hockey skates and roller blades to help protect the Achilles tendon from being cut by another player's hockey skate blade, or from being impacted by moving hockey pucks, or from being hit by another player's hockey stick, etc. Despite these safety features of the hockey skate 100, a hockey player can be subjected to injury in certain circumstances, such as in regions above an upper rim 101A of the boot 101 between the padded tongue 105 and the tendon guard 106.

Figure 2:
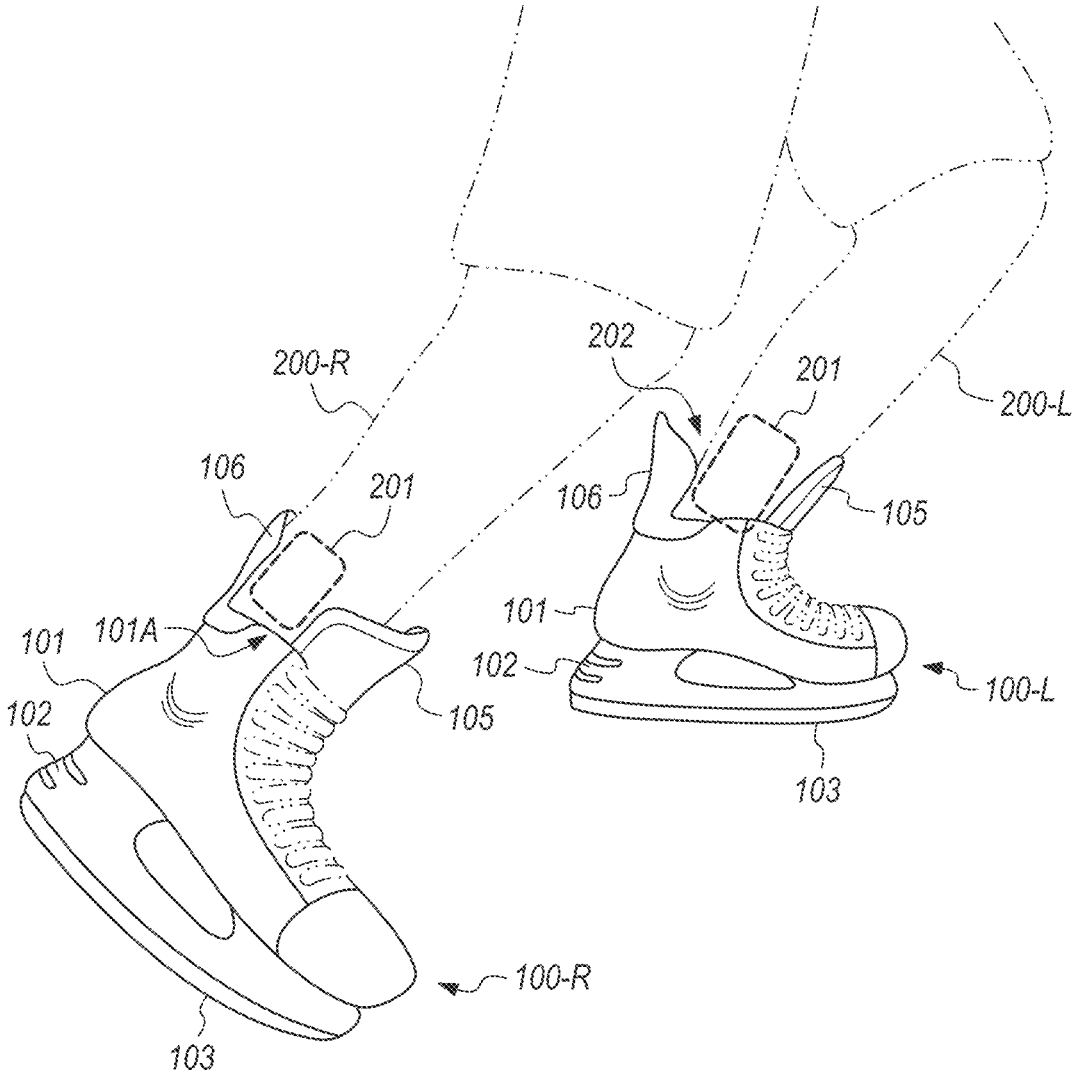
FIG. 2 schematically illustrates areas on legs of a hockey player which are vulnerable to injury during play when utilizing a standard hockey skate.

For example, FIG. 2 schematically illustrates areas on legs of a hockey player which are vulnerable to injury during play when utilizing a standard hockey skate. In particular, FIG. 2 is left and right legs 200-L and 200-R of a hockey player wearing a pair of hockey skates 100-L and 100-R (left and right foot hockey skates) which have the general design of the hockey skate 100 shown in FIG. 1. In addition, FIG. 2 illustrates exposed regions 201 (denoted by dashed-line regions) on the left and right legs 200-L and 200-R of the hockey player, which are not covered by portions of the hockey skates 100-L and 100-R. The exposed regions 201 include the unprotected regions on both sides of the lower legs above the upper rim 101A of the boot 101, between the side edges of the padded tongue 105 and the tendon guard 106. The exposed regions 201 correspond to, e.g., upper ankle joint regions, e.g., regions where the ankle joint connects the bones of the leg (e.g., fibula and tibia) to the talus bone of the ankle/foot. The exposed regions 201 can be subjected to high-speed impacts by hockey pucks, leading to broken or fractured bones. For example, common injuries in hockey include tibial shaft fractures that are caused by, e.g., high-speed impacts from hockey pucks.

In addition, as schematically illustrated in FIG. 2, when the skater bends his/her knee forward (e.g., knee of left leg 200-L as shown in FIG. 2), a gap 202 can open between tendon guard 106 and the backside of the leg, thus exposing the skater's Achilles tendon to potential injury from high-speed puck impacts, or from being cut by the blade of another player's hockey skate. Indeed, when players are in tight quarters, whether in the corners of the rink, along the wall or in open ice and fighting for the puck, players converge on each other and in doing so, the blade of the skate from other players, can inadvertently or accidentally make contact or slice against the exposed portion (e.g., Archilles tendon) of the player's leg in the open gap 202. In this regard, the tendon guard 106 can be ineffective in preventing serious injury to the Achilles tendon due to a sharp blade of another player's hockey skate making contact to the exposed region of leg in the open gap 202 below a top edge of the tendon guard 106. Since the skate blade can be rather long (from the tip of the boot to the heel), the cut to an Archilles tendon or ankle can be very deep due to a long cutting motion of a skate blade. Indeed, the concentration of applied force exerted by a blade edge on given object increases the pressure exerted by the blade edge, where such force can result in the blade edge cutting through the object, e.g., soft material (e.g., sock), flesh, and tendons/ligaments, etc.

The effectiveness of the tendon guard 106 in protecting a player's Archilles tendon is determined, in part, by how flexible or inflexible the tendon guard 106 of the hockey skate 100 is designed to be. Some manufacturers of hockey skates design the tendon guard 106 to more rigid and less flexible, which can limit the amount of spreading (and thus minimize the size of the gap 202) between the tendon guard 106 the backside of the player's leg as the player bends his/her knee forward during play. However, the when the tendon guard 106 is made to be high-grade more rigid and less flexible, the movement of the skater's foot is somewhat restricted, e.g., the ankle flexion of the hockey player is more restricted, due to the rigidity of the tendon guard 106 in conjunction with the stiffness of the outer shell of the boot 101. In this regard, some skate manufacturers will make the tendon guard 106 more flexible, or otherwise eliminate the tendon guard 106, which can result in exposure, and potential injury, of the Archilles tendon during play.

In fact, some hockey players will actually cut off the tendon guards of their skates to facilitate ankle rotation and thus achieve more maneuverability and stride energy when skating, at the expense of exposing the player's Archilles tendon to potential injury. To minimize the risk of a hockey player getting cut from the skate blade of another hockey player, during play or practice, some players wear protective "cut proof" sleeves that cover the ankle and portions of the lower legs. However, such protective sleeves tend to be rather uncomfortable and cannot guarantee any protection from the slicing motion of a sharp blade and, consequently, some hockey players will not wear such protective sleeves.

As noted above, exemplary embodiments of the disclosure comprise protection devices that are configured to be utilized in conjunction with sports skates (e.g., ice hockey skates) to protect ankles and Achilles tendons from various injuries. An exemplary protection device is configured to enable a standard design of a hockey skate (e.g., ice skate 100 of FIG. 1) to be retrofitted or otherwise utilized with the protection device to provide added protection against potential injury to ankles and Achilles tendons of hockey players, while not hindering ankle mobility. For example, FIGS. 3A, 3B, 3C, and 3D are schematic and perspective illustrations of a protection device 300, according to an exemplary embodiment of the disclosure.

Figure 3A:
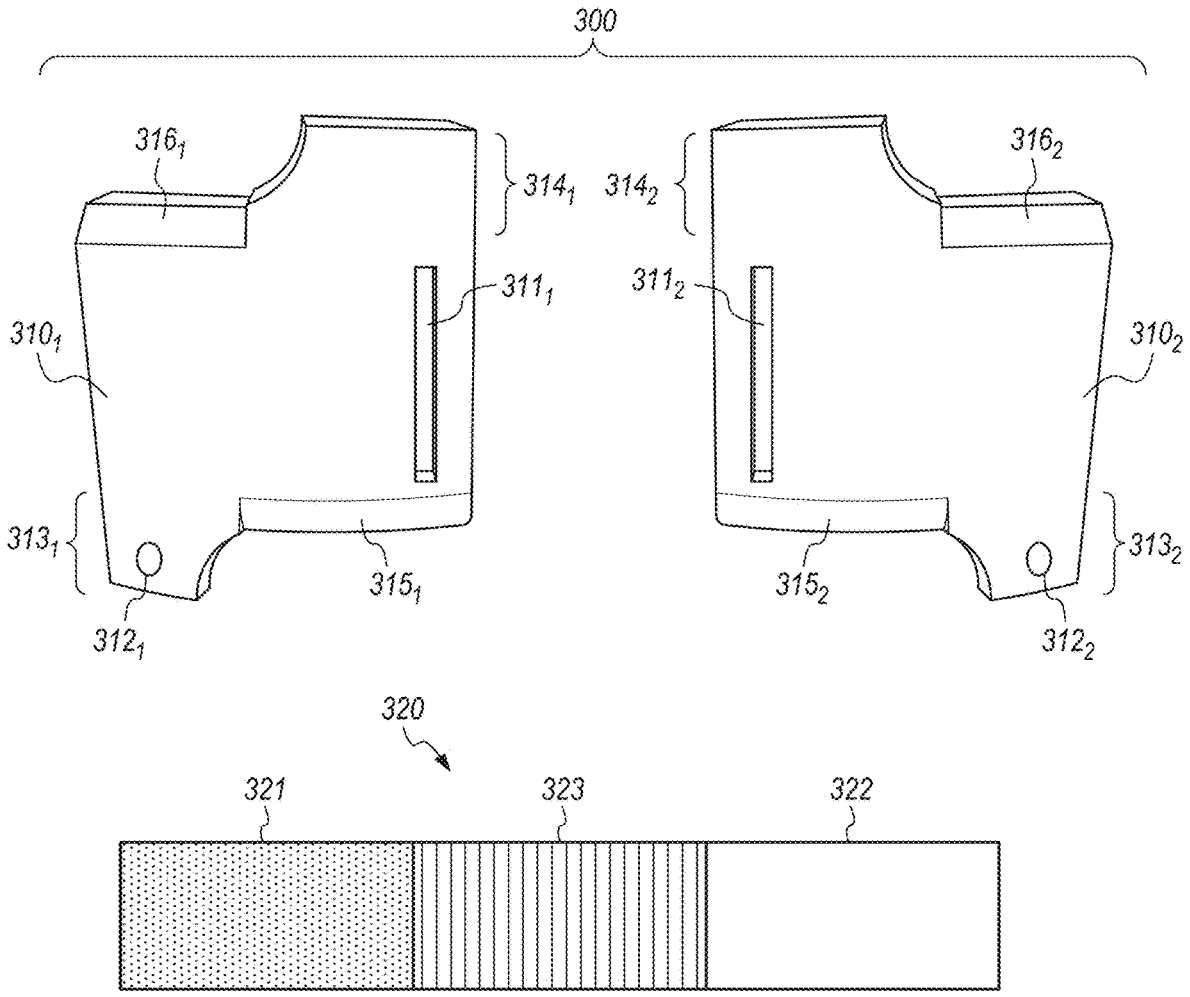
FIGS. 3A, 3B, 3C, and 3D are schematic and perspective illustrations of a protection device, according to an exemplary embodiment of the disclosure.
Figure 3B:
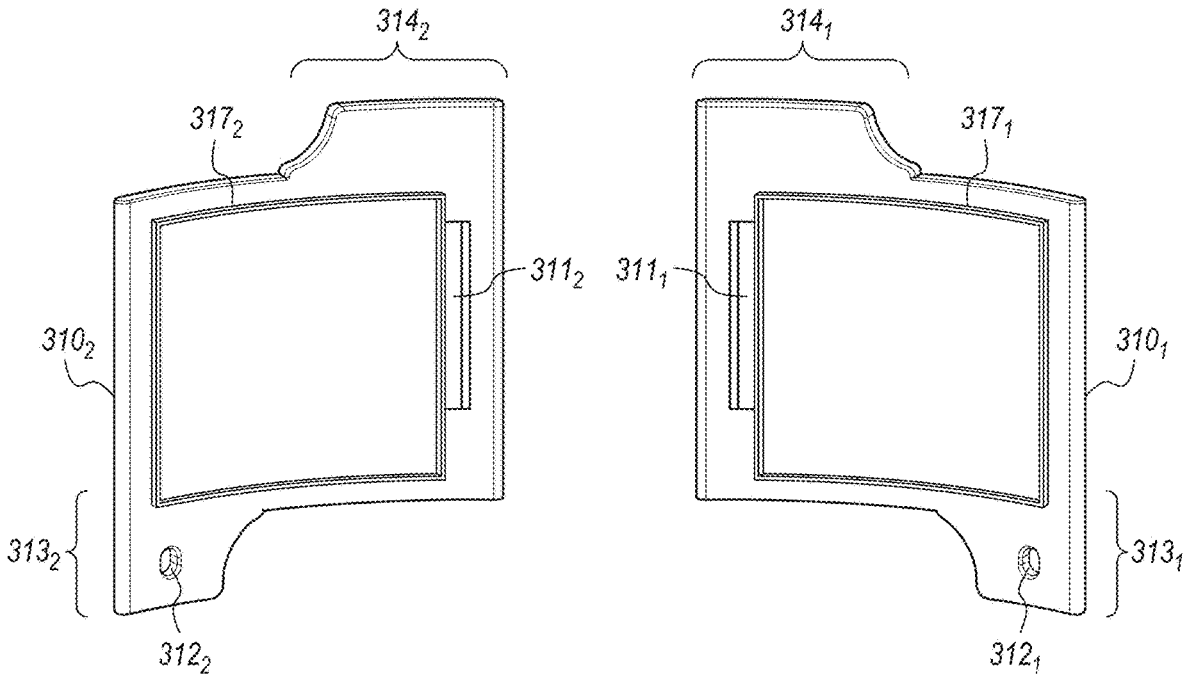
Figure 3C:
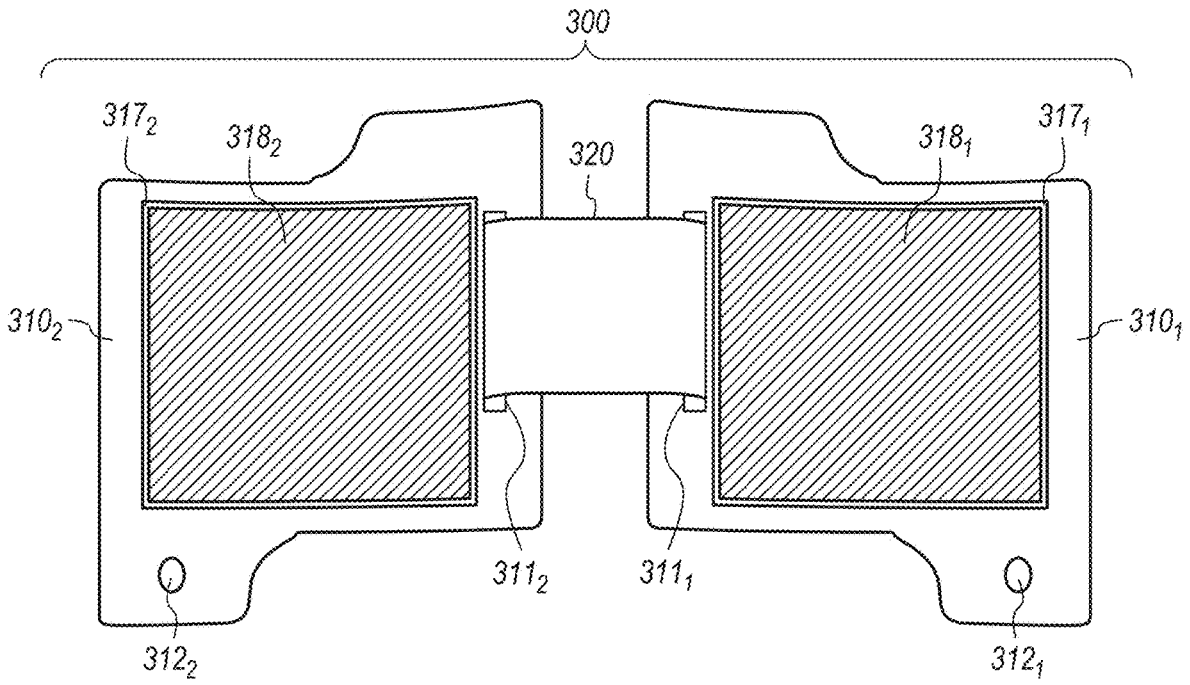
Figure 3D:
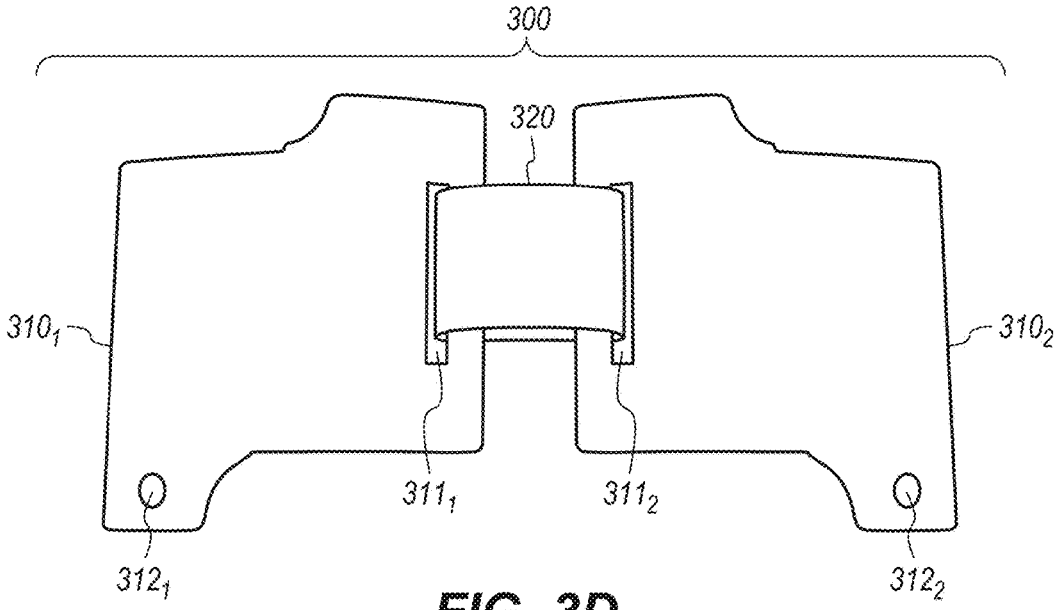

In particular, FIG. 3A illustrates various components of a protection device 300 which comprises a first protective plate $\mathbf{310}_1$ (or left plate $\mathbf{310}_1$), a second protective plate $\mathbf{310}_2$ (or right plate $\mathbf{310}_2$), and a connecting strap 320. FIG. 3A illustrates outer surfaces of the first and second protective plates $\mathbf{310}_1$ and $\mathbf{310}_2$. FIG. 3B illustrates inner surfaces of the first and second protective plates $\mathbf{310}_1$ and $\mathbf{310}_2$. FIGS. 3C and 3D illustrate the components of the protection device 300 assembled together, wherein FIG. 3C illustrates inside surfaces of the assembled protection device 300, and FIG. 3D illustrates outside surfaces of the assembled protection device 300. In the exemplary configuration, the "inside surfaces" of the first and second protective plates $\mathbf{310}_1$ and $\mathbf{310}_2$ are the surfaces which face toward the anatomy of the skater.

As shown in FIG. 3A, in some embodiments, the first protective plate $\mathbf{310}_1$ and the second protective plate $\mathbf{310}_2$ are nominally identical mirror image components. For example, the first protective plate $\mathbf{310}_1$ comprises an elongated slot $\mathbf{311}_1$, a through hole $\mathbf{312}_1$, a first extended portion $\mathbf{313}_1$ (or tongue $\mathbf{313}_1$), a second extended portion $\mathbf{314}_1$, a first beveled edge $\mathbf{315}_1$ (or first tapered edge $\mathbf{315}_1$), and a second beveled edge $\mathbf{316}_1$ (or second tapered edge $\mathbf{316}_1$). Similarly, the second protective plate $\mathbf{310}_2$ comprises an elongated slot $\mathbf{311}_2$, a through hole $\mathbf{312}_2$, a first extended portion $\mathbf{313}_2$ (or tongue $\mathbf{313}_2$), a second extended portion $\mathbf{314}_2$, a first beveled edge $\mathbf{315}_2$ (or first tapered edge $\mathbf{315}_2$), and a second beveled edge $\mathbf{316}_2$ (or second tapered edge $\mathbf{316}_2$). The first and second protective plates $\mathbf{310}_1$ and $\mathbf{310}_2$ have curved profiles that are configured to wrap around the left and right sides of an individual's lower leg, e.g., wrap around the left, right, and back sides of an upper ankle region.

The connecting strap 320 comprises a first connecting portion 321 and a second connecting portion 322, and an elastic portion 323 disposed between, and connected to, the first and second connecting portions 321 and 322. In some embodiments, the first and first and second connecting portions 321 and 322 comprise hook and pile fasteners (or hook and loop fasteners), e.g., VELCRO® fasteners. The elastic portion 323 is formed of a stretchable strap material. As shown in FIGS. 3C and 3D, when assembled, the connecting strap 320 is slid through the elongated slots $\mathbf{311}_1$ and $\mathbf{311}_2$ of the first and second protective plates $\mathbf{310}_1$ and $\mathbf{310}_2$, and the first and second connecting portions 321 and 322 are connected to form a stretchable strap loop which connects the first and second protective plates $\mathbf{310}_1$ and $\mathbf{310}_2$.

The through holes $\mathbf{312}_1$ and $\mathbf{312}_2$ serve as lace eyelets that are configured to insertably receive end portions of a boot lace of a hockey skate to thereby secure the protection device 300 to a frontside of the hockey skate (as discussed in further detail below in conjunction with FIGS. 4B and 4C). In some embodiments, the through holes $\mathbf{312}_1$ and $\mathbf{312}_2$ are oval-shaped to facilitate the threading of the end portions of the boot lace of the hockey skate therethrough, especially when the ends of the boot lace are frayed. In some embodiments, the through holes $\mathbf{312}_1$ and $\mathbf{312}_2$ are disposed on the tongues $\mathbf{313}_1$ and $\mathbf{313}_2$, respectively, wherein the tongues $\mathbf{313}_1$ and $\mathbf{313}_2$ are extended portions which extend down below the upper rim of the boot to align the through holes $\mathbf{312}_1$ and $\mathbf{312}_2$ with upper eyelets of the boot (e.g., eyelet 107 of the boot 100, FIG. 1) to facilitate connection via the boot lace.

While the tongues $\mathbf{313}_1$ and $\mathbf{313}_2$ are each shown to have one through hole (i.e., through holes $\mathbf{312}_1$ and $\mathbf{312}_2$), in other embodiments, the tongues $\mathbf{313}_1$ and $\mathbf{313}_2$ can be designed to be longer and each have one or more additional through holes which are aligned or substantially aligned to other eyelets of the boot (e.g., second and third eyelets down from the upper rim of the boot). This would allow the protection device 300 to be tied to the frontside of the hockey boot in a more secure manner by threading the boot lace through more through holes and corresponding boot eyelets. In addition, this would allow a skater to secure the protection device 300 to the frontside of the boot by using a lower eyelet in instances where the skater prefers to not thread the boot lace through the upper eyelets of the boot and tie the boot tight using the upper eyelets.

The beveled edges $\mathbf{315}_1$ and $\mathbf{315}_2$ on the bottom portions of the respective first and second protective plate $\mathbf{310}_1$ and $\mathbf{310}_2$ are configured to enable the beveled edges $\mathbf{315}_1$ and $\mathbf{315}_2$ of the first and second protective plates $\mathbf{310}_1$ and $\mathbf{310}_2$ to be wedged between an upper rim of the hockey boot and the leg of an individual.

The second extended portions $\mathbf{314}_1$ and $\mathbf{314}_2$ on upper portions of the respective first and second protective plates $\mathbf{310}_1$ and $\mathbf{310}_2$ are configured to provide extended lengths of the protective plates for added coverage and protection on the backside of an individual's leg, covering the Achilles tenon and lower calf. The beveled edges $\mathbf{316}_1$ and $\mathbf{316}_2$ on the upper portions of the respective first and second protective plate $\mathbf{310}_1$ and $\mathbf{310}_2$ are configured to enable the beveled edges $\mathbf{316}_1$ and $\mathbf{316}_2$ of the first and second protective plates $\mathbf{310}_1$ and $\mathbf{310}_2$ to be wedged between a lower edge of a shin guard (which may be worn by a hockey player) and the lower shin region of the individual, the details of which will be explained in further detail below in conjunction with FIG. 4D.

As further shown in FIGS. 3B and 3C, in some embodiments, the first and second protective plates $310_1$ and $310_2$ comprise (i) protruding ribs that define rectangular frames $317_1$ and $317_2$ on the inner surfaces of the respective first and second protective plates $310_1$ and $310_2$ and (ii) first and second pad elements $318_1$ and $318_2$ that are disposed within the respective rectangular frames $317_1$ and $317_2$. The pad elements $318_1$ and $318_2$ comprise soft pads, e.g., rubber pads (e.g., neoprene pads) or gel pads, which are fixedly secured (e.g., glued) on the inner surfaces of the respective first and second protective plates $310_1$ and $310_2$, and disposed within the inner region defined by the rectangular frames $317_1$ and $317_2$. The pad elements $318_1$ and $318_2$ are configured to provide added protection by absorbing the impact of blunt forces applied from high-speed impacts from hockey pucks, or from impacts from hockey sticks or hockey blades of other players. The rectangular frames $317_1$ and $317_2$ are configured to prevent the edges of the pad elements $318_1$ and $318_2$ from peeling up and becoming loose, as a result of using the protection device 300 over time. In this regard, the edges of the pad elements $318_1$ and $318_2$ can be glued to the inner sidewalls of the respective rectangular frames $317_1$ and $317_2$ to prevent the edges of the pad elements $318_1$ and $318_2$ from peeling up.

The first and second protective plates $310_1$ and $310_2$ are formed of a rigid or semi-rigid material (e.g., plastic material) that is configured to protect an individual's lower leg (e.g., upper ankle regions, and Archilles tendon, etc.) against high-impact forces (e.g., hockey pucks) and from being sliced by the skate blade of another player, without the first and second protective plates $310_1$ and $310_2$ from being cracked or sliced in pieces by high-impact forces and skate blades. In some embodiments, the first and second protective plates $310_1$ and $310_2$ are formed of a thermoplastic polymer material, such as a polycarbonate material. The first and second protective plates $310_1$ and $310_2$ are formed of a thermoplastic polymer material using a suitable polymer processing techniques such as injection molding, compression molding, etc. The first and second protective plates $310_1$ and $310_2$ can be formed with any desired thickness. For example, in some non-limiting embodiments, the first and second protective plates $310_1$ and $310_2$ are formed with a thickness in a range of about 3/16 inch to about 5/8 inch.

The first and second protective plates $310_1$ and $310_2$ and the first and second pad elements $318_1$ and $318_2$ are collectively configured to provide protection from injury by absorbing the impact of blunt forces applied from high-speed impacts from hockey pucks, or from impacts from hockey sticks or hockey blades of other players. Indeed, the first and second protective plates $310_1$ and $310_2$ provide a hard shell covering to guard the ankle region and Archilles tendon of an individual from being sliced or cut by hockey blades of other players. In addition, the first and second protective plates $310_1$ and $310_2$ and the first and second pad elements $318_1$ and $318_2$ are configured to absorb, distribute, and dissipate (and thereby protect against) hard blunt forces that arise from high-speed impacts of hockey pucks, or otherwise, against the protection device 300.

Figure 4A:
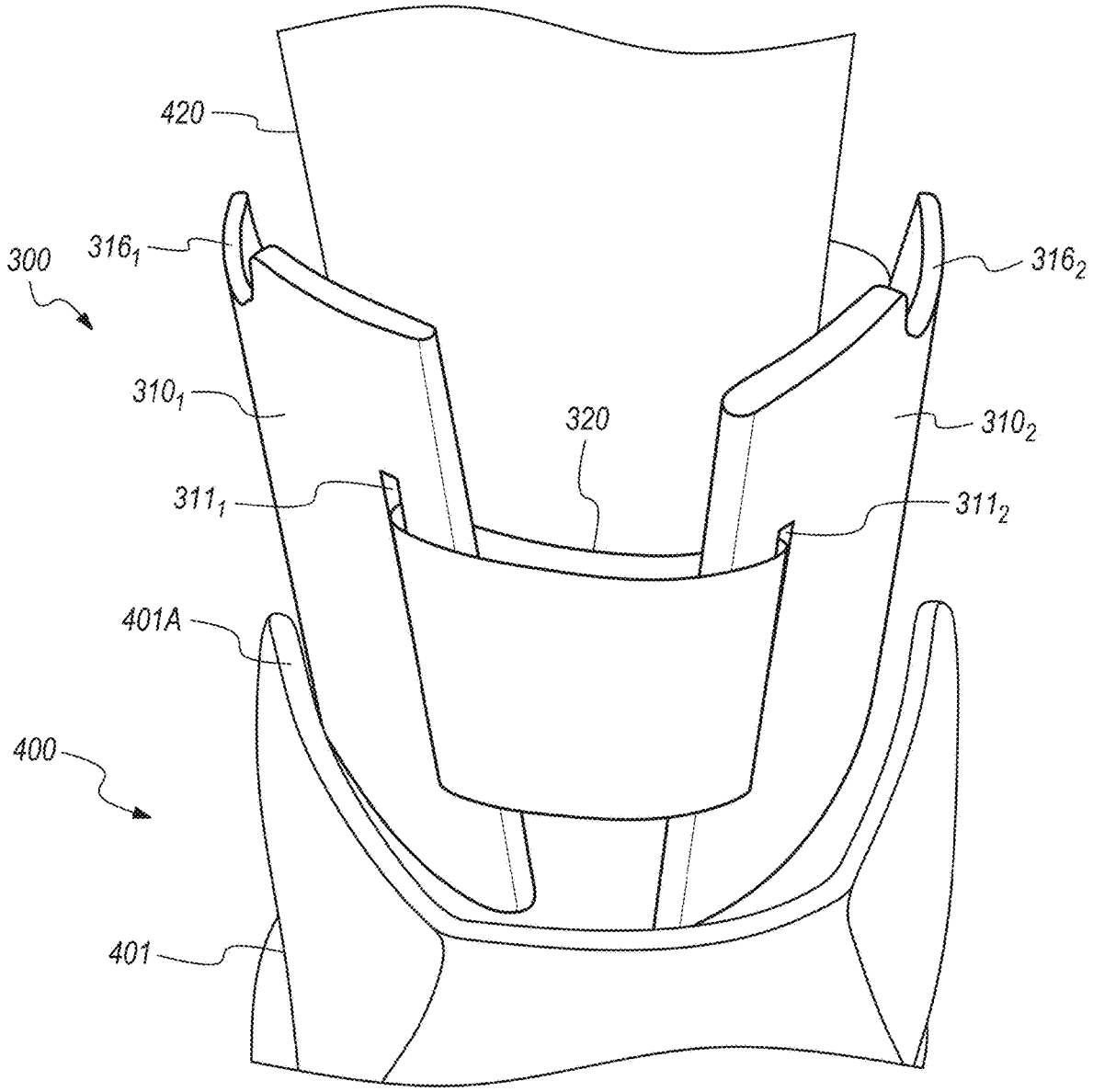
FIG. 4A is a perspective back side view of a protection device that is installed with a hockey skate, according to an exemplary embodiment of the disclosure.
Figure 4B:
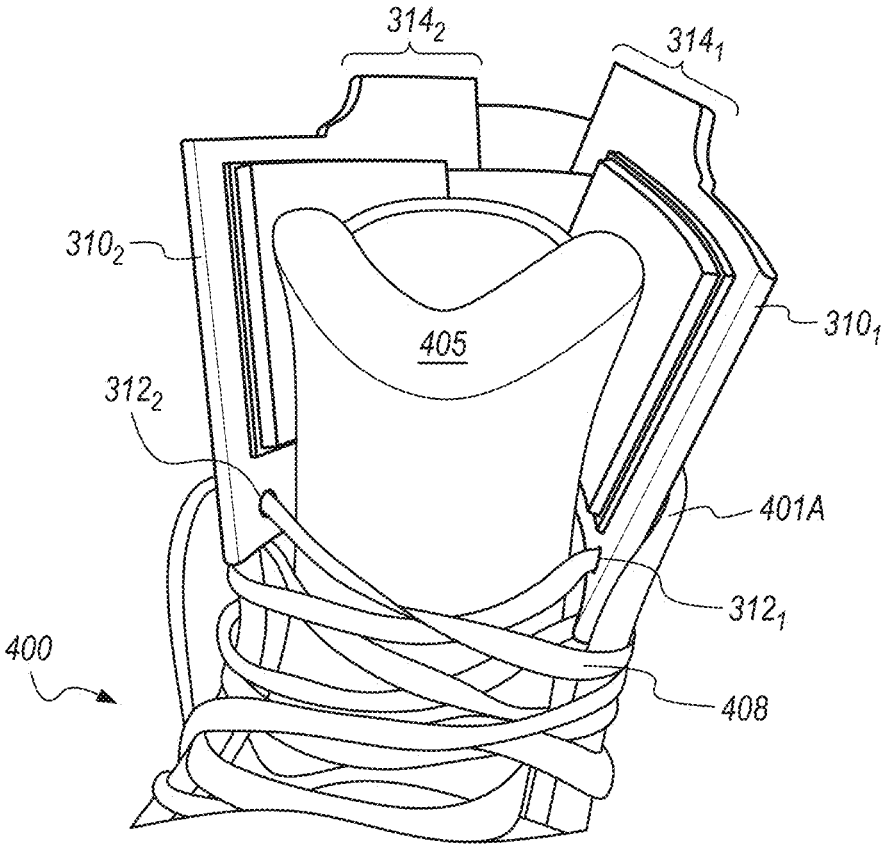
FIG. 4B is a perspective front side view of a protection device that is installed with a hockey skate, according to an exemplary embodiment of the disclosure.
Figure 4C:
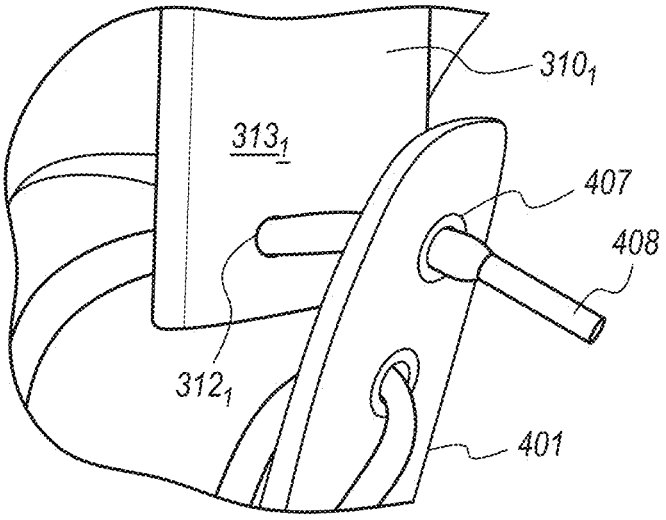
FIG. 4C illustrates a method for connecting a protection device to a hockey skate, according to an exemplary embodiment of the disclosure.

FIGS. 4A, 4B, 4C and 4D illustrate different views of the protection device 300 installed with a hockey skate, according to exemplary embodiments of the disclosure. For example, FIG. 4A is a perspective backside view of the protection device 300 installed with a hockey skate, according to an exemplary embodiment of the disclosure. In particular, FIG. 4A illustrates a hockey skate 400 that is retrofitted with the exemplary protection device 300. FIG. 4A illustrates a backside of a boot 401 of the hockey skate 400 (with the tendon guard removed), where the first and second protective plates $310_1$ and $310_2$ of the protection device 300 disposed adjacent to and covering left and right ankle portions, respectively, of an individual's leg 420, as well as covering the Archilles tendon. FIG. 4A illustrates an exemplary configuration in which the protection device 300 can be used with a hockey skate that has no tendon guard by design, or which is purposefully removed by an individual to enable more flexible movement when skating. In this regard, the protection device 300 can provide the same or similar protection as that provided by a tendon guard, while providing flexibility of ankle movement, which could otherwise be impeded by the presence of the tendon guard, as discussed above. It is to be noted that while adjacent backside side edges of the first and second protective plates $310_1$ and $310_2$ are shown in FIG. 4A to be spaced apart, the elastic strap 320 can be adjustably tightened to bring the adjacent backside side edges of the first and second protective plates $310_1$ and $310_2$ closer together, as desired.

As further shown in FIG. 4A, the bottoms portions (i.e. beveled edges $315_1$ and $315_2$) of the first and second protective plates $310_1$ and $310_2$ are disposed inside an upper rim 401A of the boot 401 with the clastic strap 320 inserted through the elongated slots $311_1$ and $311_2$, thereby connecting the first and second protective plates $310_1$ and $310_2$. As noted above, the clastic strap 320 can be adjusted to custom fit (tighter or looser) around the ankle region and Archilles tendon as desired. With this design, once the clastic strap 320 is connected to form the loop, the clastic portion 323 of the elastic strap 320 (FIG. 3A) will stretch back and forth as the player is skating and moving. In this regard, while the elastic strap 320 can be adjusted to tightly fit the protection device 300 around the ankle region, the stretching of the elastic strap 320 will prevent the protection device 300 from impeding ankle movement as the player bends his/her knee or as the ankle naturally rotates in various directions as the player is skating and moving during play.

FIG. 4B is a perspective frontside view of the protection device 300 installed with the hockey skate 400, according to an exemplary embodiment of the disclosure. In particular, FIG. 4B illustrates an exemplary method to connect the protection device 300 to the boot 401 of the hockey skate 400 using a boot lace 408. In addition, FIG. 4C illustrates the exemplary method for connecting the protection device 300 to the boot 401 of the hockey skate 400. As shown in FIGS. 4B and 4C, the protection device 300 is connected to the boot 401 by threading ends of the boot lace 408 through the through holes $312_1$ and $312_2$ of the respective tongues $313_1$ and $313_2$ of the respective first and second protective plates $310_1$ and $310_2$. The tongues $313_1$ and $313_2$ of the respective first and second protective plates $310_1$ and $310_2$ extend down below the upper rim 401A of the boot 401, and are disposed between a padded tongue 405 and the inner surface of the upper rim 401A in the frontside of the boot 401, where the through holes $312_1$ and $312_2$ are aligned to, e.g., the upper eyelets 407 of the boot 401. The end portions of the boot lace 408 are threaded through the through holes $312_1$ and $312_2$ and the upper eyelets 407 on both sides of the boot 401 so that when the boot lace 408 is tightened and tied, the protection device 300 is held in place at the frontside of the boot 401.

In this regard, the protection device 300 is attachable to a top portion of the hockey skate 400 by using the boot lace 408 to tie the protection device 300 to the top portion of the boot 401. When installing the protection device 300, the individual can place the assembled protection device 300 (e.g., the first and second protective plates $\mathbf{310}_1$ and $\mathbf{310}_2$ connected by the elastic strap 320, as shown in FIGS. 3C and 3D) around the individual's ankles and Achilles tendon, and then lace and tie the protection device 300 to the boot 401. When tightening the boot lace 408 and forming the lace knot, the protection device 300 will be held in place. The individual can then adjust the tightness of the protection device 300 by adjusting the elastic strap 320 and/or adjusting the tightness of the lace tie.

Although the protection device 300 is secured by the boot lace 408, and encircles the upper ankle region and Archilles tendon, as noted above, the protection device 300 is not fixedly attached to the boot 401 in any other manner. The elastic strap 320 provides flexibility to enable flexible movement of the protection device 300 as the skater moves in various directions, without the bottom tapered portions $\mathbf{315}_1$ and $\mathbf{315}_2$ of the protection device 300 (which are wedged between leg of the player and the upper rim 401A of the boot 401) from being dislodged out of position and rising above the upper rim 401A of the boot 401. For those hockey players that utilize protective sleeves to cover their lower legs, the protection device 300 can be further held in place by sliding a protective sleeve over the protection device 300.

Figure 4D:
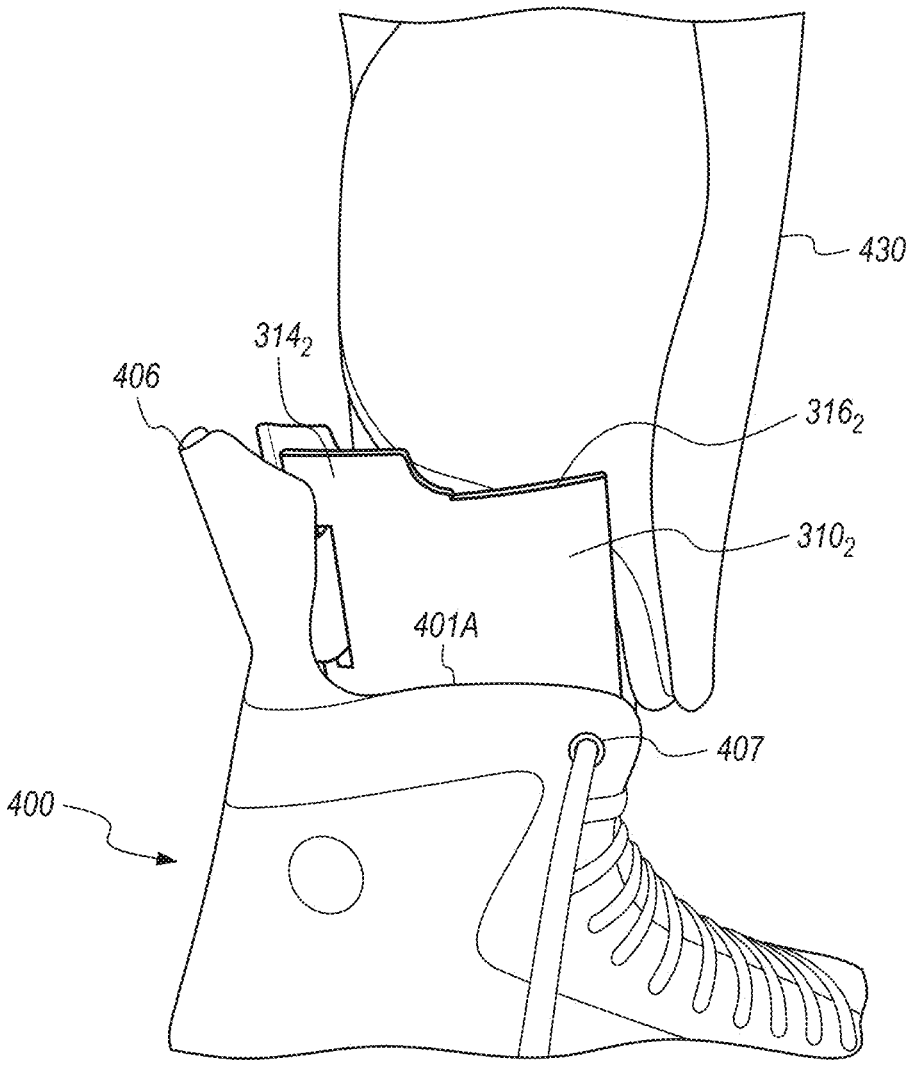
FIG. 4D is a perspective side view of a protection device that is installed with a hockey skate, according to an exemplary embodiment of the disclosure.

FIG. 4D is a perspective side view of the protection device 300 installed with the hockey skate 400 having a tendon guard 406, according to an exemplary embodiment of the disclosure. FIG. 4D further illustrates a shin guard 430 that is typically utilized by a hockey player to protect the shin from injury. The shin guard 430 has a tapered bottom edge which is longer on a frontside thereof which extends down toward an upper portion of the padded tongue 405 of the hockey skate 400. Although not specifically shown in FIG. 4D, the beveled (tapered) edges $\mathbf{316}_1$ and $\mathbf{316}_2$ on the upper edges of the respective first and second protective plates $\mathbf{310}_1$ and $\mathbf{310}_2$ can be wedged between the skater's leg and an inner surface of the bottom edge of the shin guard 430 to further hold the protection device 300 in place. Moreover, in instances where the shin guard 430 is initially positioned with the bottom edge of the shin guard 430 disposed above the upper edges of the first and second protective plates $\mathbf{310}_1$ and $\mathbf{310}_2$, if the shin guard 430 happens to move down during play, the beveled (tapered) edges $\mathbf{316}_1$ and $\mathbf{316}_2$ on upper edges of the respective first and second protective plates $\mathbf{310}_1$ and $\mathbf{310}_2$ can naturally slide between the bottom edge of the shin guard 430 and the individual's leg, such that the shin guard 430 will not exert undue force on the protection device 300 and vice versa, thereby allowing the protection device 300 to operate as intended while the individual is skating and moving during play.

Although exemplary embodiments have been described herein with reference to the accompanying figures, it is to be understood that the current disclosure is not limited to those precise embodiments, and that various other changes and modifications may be made therein by one skilled in the art without departing from the scope of the appended claims.

What is claimed is:

1. A protection device, comprising:

a first protective plate having a first tongue portion and a first through hole formed in the first tongue portion, wherein the first tongue portion extends below a horizontal bottom edge of the first protective plate;

a second protective plate having a second tongue portion and a second through hole formed in the second tongue portion, wherein the second tongue portion extends below a horizontal bottom edge of the second protective plate; and a flexible strap which is configured to couple a back edge of the first protective plate and a back edge of the second protective plate;

wherein the protection device is structurally configured for installation to a boot of a skate by threading a first end of a lace of the boot through the first through hole and a first eyelet of the boot aligned to the first through hole, and threading a second end of the lace through the second through hole and a second eyelet of the boot which is aligned to the second through hole, and tying the lace to secure the protection device to the boot.

2. The protection device of claim 1, wherein the first protective plate is configured to cover a left ankle region and a first portion of an Achilles tendon of an individual, and the second protective plate is configured to cover a right ankle region and a second portion of the Achilles tendon of the individual.

3. The protection device of claim 1, wherein the first protective plate and the second protective plate each comprise a curved profile which is configured to wrap around upper ankle regions of an individual.

4. The protection device of claim 1, wherein the first protective plate and the second protective plate are formed of a rigid or semi-rigid plastic material.

5. The protection device of claim 1, wherein:

the first protective plate comprises a first pad element disposed on an inner surface of the first protective plate; and the second protective plate comprises a second pad element disposed on an inner surface of the second protective plate.

6. The protection device of claim 5, wherein the first pad element and the second pad element each comprise a rubber pad or a gel pad.

7. The protection device of claim 1, wherein the horizontal bottom edge of the first protective plate and the horizontal bottom edge of the second protective plate each comprise a tapered edge which is configured to enable the horizontal bottom edges of the respective first and second protective plates to slideably engage an inner surface of the upper rim of the boot.

8. The protection device of claim 1, wherein:

the first protective plate comprises a first extended portion which extends above a first upper edge of the first protective plate;

the second protective plate comprises a second extended portion which extends above a second upper edge of the second protective plate;

the first extended portion and the second extended portion are configured and positioned to cover an Achilles tendon region of an individual, when the protection device is installed on the skate.

9. The protection device of claim 8, wherein the first upper edge and the second upper edge each comprise a tapered edge which is configured to enable the first and second upper edges of the respective first and second protective plates to slideably engage an inner surface of a shin guard.

10. The protection device of claim 1, wherein:

the first protective plate comprises a first slot;

the second protective plate comprises a second slot; and the flexible strap comprises a first connecting portion and a second connecting portion, and is configured to be inserted through the first slot and the second slot and couple the first protective plate and the second protective plate by connecting the first connecting portion to the second connecting portion.

11. The protection device of claim 10, wherein:

the flexible strap further comprises a stretchable portion which is disposed between, and coupled to, the first and second connecting portions; and the first and second connecting portions comprise hook and pile fasteners.

* * * * *